US012716302B1

(12) United States Patent
Klein et al.

(10) Patent No.: US 12,716,302 B1
(45) Date of Patent: Aug. 25, 2026

(54) HYDRAULIC SPIDER SYSTEM AND METHODS FOR USE THEREOF

(71) Applicant: FORUM US, INC., Houston, TX (US)

(72) Inventors: Johann Klein, Hamburg (DE); Arne Pross, Hamburg (DE); Rumen Mittelstädt, Hamburg (DE)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 19/060,558

(22) Filed: Feb. 21, 2025

(51) Int. Cl.
*E21B 19/10* (2006.01)

(52) U.S. Cl.
CPC ..... *E21B 19/10* (2013.01)

(58) Field of Classification Search
None
See application file for complete search history.

(56) References Cited

U.S. PATENT DOCUMENTS 1,556,094 A * 10/1925 Fletcher ..... E21B 19/10 175/423
1,559,932 A * 11/1925 Bogen ..... E21B 19/10 175/423
1,749,945 A * 3/1930 Kaough ..... E21B 19/10 175/423
2,962,919 A * 12/1960 Grundmann ..... E21B 19/10 269/283
3,197,835 A * 8/1965 Brown ..... E21B 19/10 294/102.2
4,269,277 A * 5/1981 Baugh ..... E21B 19/10 173/149
6,212,976 B1 4/2001 Stogner
7,013,759 B1 3/2006 Childress, II
7,032,690 B2 4/2006 Ramey et al.
7,117,938 B2 10/2006 Hamilton et al.
7,134,531 B2 * 11/2006 Ramey ..... E21B 19/10 188/67
7,216,717 B2 5/2007 Severin et al.
7,296,630 B2 11/2007 Severin et al.
7,398,833 B2 7/2008 Ramey et al.
7,510,033 B2 3/2009 Lutzhoft et al.
7,699,098 B2 4/2010 Hamilton
8,079,627 B2 12/2011 Lutzhoft et al.
8,596,344 B2 12/2013 Lutzhoft et al.
9,057,225 B2 6/2015 Vierke et al.
9,062,698 B2 6/2015 Baier et al.
(Continued)

FOREIGN PATENT DOCUMENTS

CA 2122623 C 8/2001
CA 2224638 C 2/2004
CA 2943038 C 11/2021

OTHER PUBLICATIONS

FMS-350-275-C Flush Mounted Spider, Technical Manual No. TM-FMS-350-01, McCoy Global, 156 pages.

*Primary Examiner* — Blake Michener

(57) ABSTRACT

A slip for use in a hydraulic spider is provided. The slip including a slip body, a first insert coupled to the slip body, and a second insert coupled to the slip body. The first insert including a first engagement surface. The first engagement surface includes one or more first teeth oriented in a first direction. The second insert disposed below the first insert. The second insert including as second engagement surface. The second engagement surface includes one or more second teeth oriented in a second direction.

17 Claims, 7 Drawing Sheets

(56) References Cited

U.S. PATENT DOCUMENTS

| | | | | |
|---|---|---|---|---|
| 9,181,762 | B2 | 11/2015 | Stoldt et al. | |
| 9,976,365 | B2 | 5/2018 | Vierke et al. | |
| 10,316,597 | B2 | 6/2019 | Rios | |
| 10,329,854 | B2 | 6/2019 | Rios et al. | |
| 10,544,636 | B1 | 1/2020 | Vierke et al. | |
| 10,570,679 | B2 | 2/2020 | Stoldt et al. | |
| 10,648,254 | B2 | 5/2020 | Meuth | |
| 10,753,162 | B2 | 8/2020 | Vo | |
| 10,767,425 | B2 | 9/2020 | Meuth et al. | |
| 10,808,468 | B2 | 10/2020 | Vo | |
| 10,808,469 | B2 | 10/2020 | Vo | |
| 10,808,470 | B2 | 10/2020 | Vo | |
| 11,156,038 | B1 | 10/2021 | Granger et al. | |
| 2004/0011600 | A1* | 1/2004 | Ramey | E21B 19/10 188/67 |
| 2017/0234083 | A1* | 8/2017 | Tavakoli | E21B 19/06 166/77.52 |
| 2019/0071940 | A1* | 3/2019 | Sonnier | E21B 19/10 |
| 2019/0136647 | A1* | 5/2019 | Vierke | E21B 19/10 |
| 2024/0269787 | A1 | 8/2024 | Granger et al. | |
| 2024/0410238 | A1 | 12/2024 | Granger et al. | |

* cited by examiner

HYDRAULIC SPIDER SYSTEM AND METHODS FOR USE THEREOF

BACKGROUND

Field

Embodiments disclosed herein generally relate to a hydraulic spider for use in the oil and gas industry. In particular, embodiments disclosed herein relate to a hydraulic spider for engaging tubulars in drilling, workover, and other operations requiring tubular handling.

Description of the Related Art

A hydraulic spider is commonly used in the oil and gas industry to hold tubulars when making-up or breaking-out a threaded connection. The hydraulic spider sits in a drilling table. A tubular string, including multiple tubulars connected together, is lowered into the spider from above by an elevator. The hydraulic spider then holds a tubular of the tubular string. The elevator releases the tubular string, is moved to engage another tubular, and lowers the other tubular to a position above the tubular string. A wrench tool engages and rotates the tubular held by the elevator relative to the tubular string. The wrench tool can rotate the tubular to thread the tubulars together during a make-up operation or can rotate the tubular to unthread the tubulars from one another during a break-out operation.

Hydraulic spiders hold the tubulars using slips that retain the tubulars during make-up or break-out operations. Tubulars need to be sufficiently retained with enough grip so that the tubulars can be made up or broken out with appropriate torque. Accordingly, there is a continuous need for new and/or improved hydraulic spider systems including improved slips for retaining tubulars during make-up or break-out operations.

SUMMARY

In one or more embodiments, a slip for use in a hydraulic spider is provided. The slip including a slip body, a first insert coupled to the slip body, and a second insert coupled to the slip body. The first insert including a first engagement surface. The first engagement surface includes one or more first teeth oriented in a first direction. The second insert disposed below the first insert. The second insert including as second engagement surface. The second engagement surface includes one or more second teeth oriented in a second direction.

In one or more embodiments, a slip for use in a hydraulic spider is provided. The slip includes a slip body, a first insert, and a second insert. The first insert is at least partially disposed in the slip body. The first insert includes one or more first teeth oriented in a first direction. The second insert is at least partially disposed in the slip body and disposed below the first insert. The second insert includes one or more second teeth oriented in a second direction. The second direction is perpendicular to the first direction.

In one or more embodiments, a hydraulic spider is provided. The hydraulic spider including a hydraulic spider body and one or more slips. The hydraulic spider body including a bore and one or more actuation surfaces. The one or more actuation surfaces includes a taper angle of at least about 11 degrees. The one or more slips are engaged with the one or more actuation surfaces such that movement along the one or more actuation surfaces causes the one or more slips to move radially inward towards a center of the bore or radially outward away from the center of the bore. The one or more slips including one or more inserts defining an inner surface of each slip. The one or more inserts including a first insert and a second insert. The first insert includes one or more first teeth oriented in a first direction. The second insert is disposed below the first insert. The second insert includes one or more second teeth oriented in a second direction. The second direction is different from the first direction.

BRIEF DESCRIPTION OF THE DRAWINGS

So that the manner in which the above-recited features of the disclosure can be understood in detail, a more particular description of the disclosure, briefly summaries above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The disclosure contemplates that terms such as "couples," "coupling," "couple," and "coupled" may include but are not limited to welding, interference fitting, magnetic coupling, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Aspects of the present disclosure provide systems, apparatus, and methods related to a hydraulic spider. The hydraulic spider includes a spider body, actuators, and slips. The slips are configured to extend toward the central axis of the bore of the hydraulic spider and retract away from the central axis of the bore by sliding along angled actuating surfaces. The slips include slip inserts. The slip inserts include one or more inserts with horizontal teeth and one or more inserts with vertical teeth.

Figure 1:
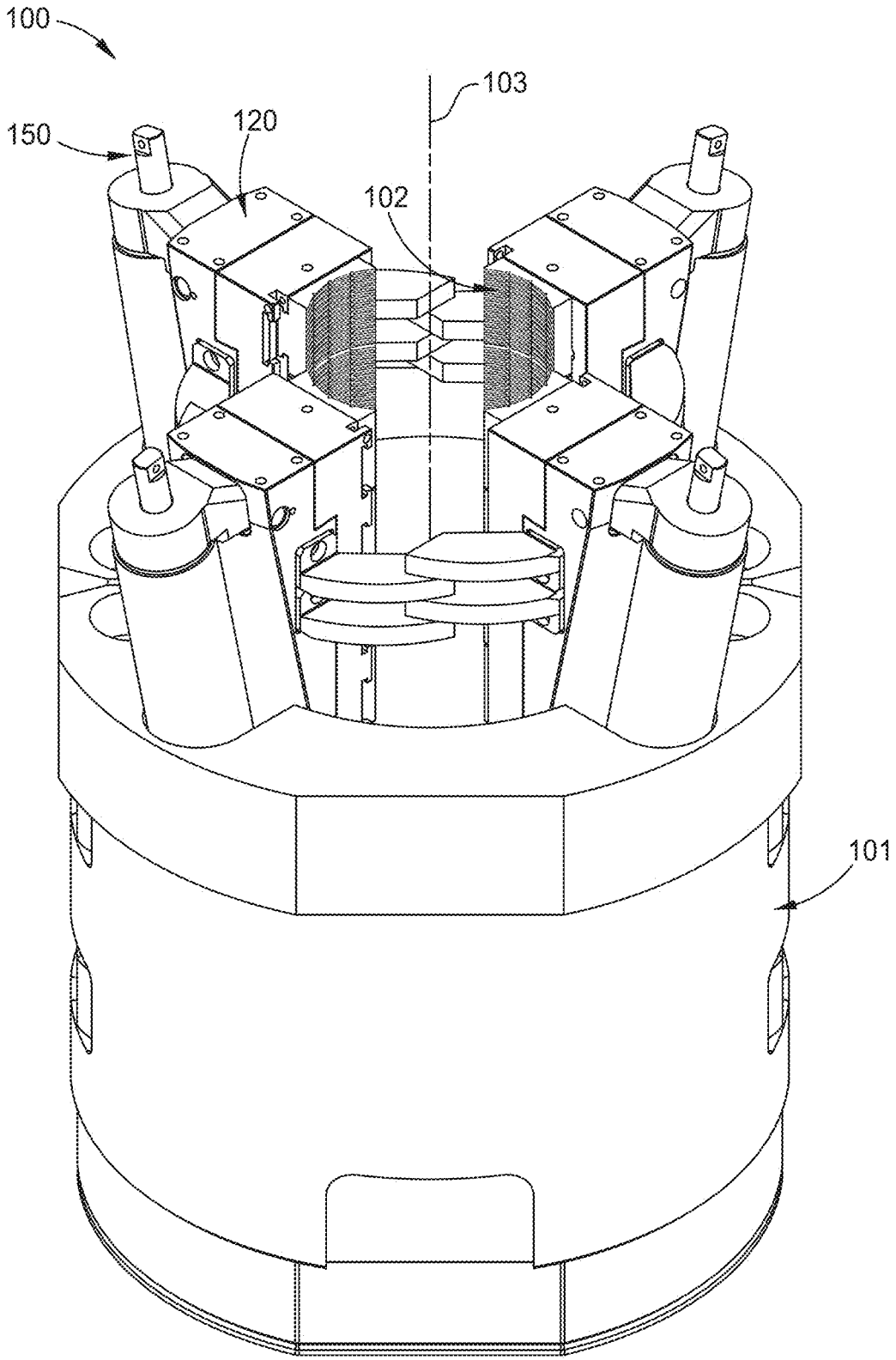
FIG. 1 illustrates an isometric view of a hydraulic spider, according to one or more embodiments.

FIG. 1 illustrates an isometric view of a hydraulic spider 100. The hydraulic spider 100 includes a spider body 101 and slips 120 disposed in the spider body 101. Some components, such as a top cover, that are located on top of the hydraulic spider 100 have been removed for clarity.

The spider body 101 is generally cylindrical with a bore 102 through a central axis 103 of the hydraulic spider 100. In one or more embodiments, the spider body 101 is made up of two or more body portions that may be coupled to one another. For example, the two body portions may be pivotally coupled to one another to open and close.

Figure 2A:
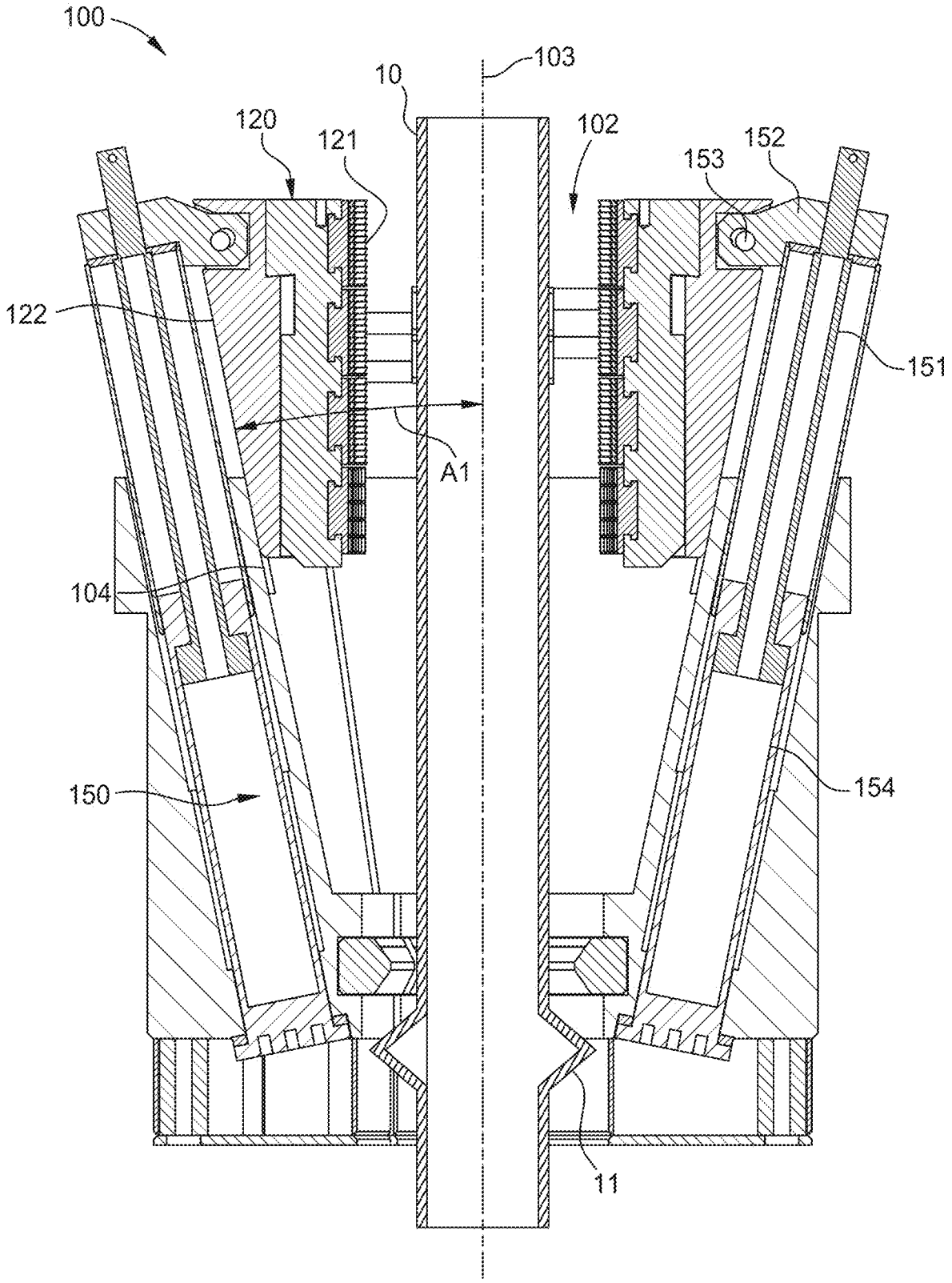
FIG. 2A illustrates a cross-sectional view of the hydraulic spider of FIG. 1 with the slips in a set-back position, according to one or more embodiments.
Figure 2B:
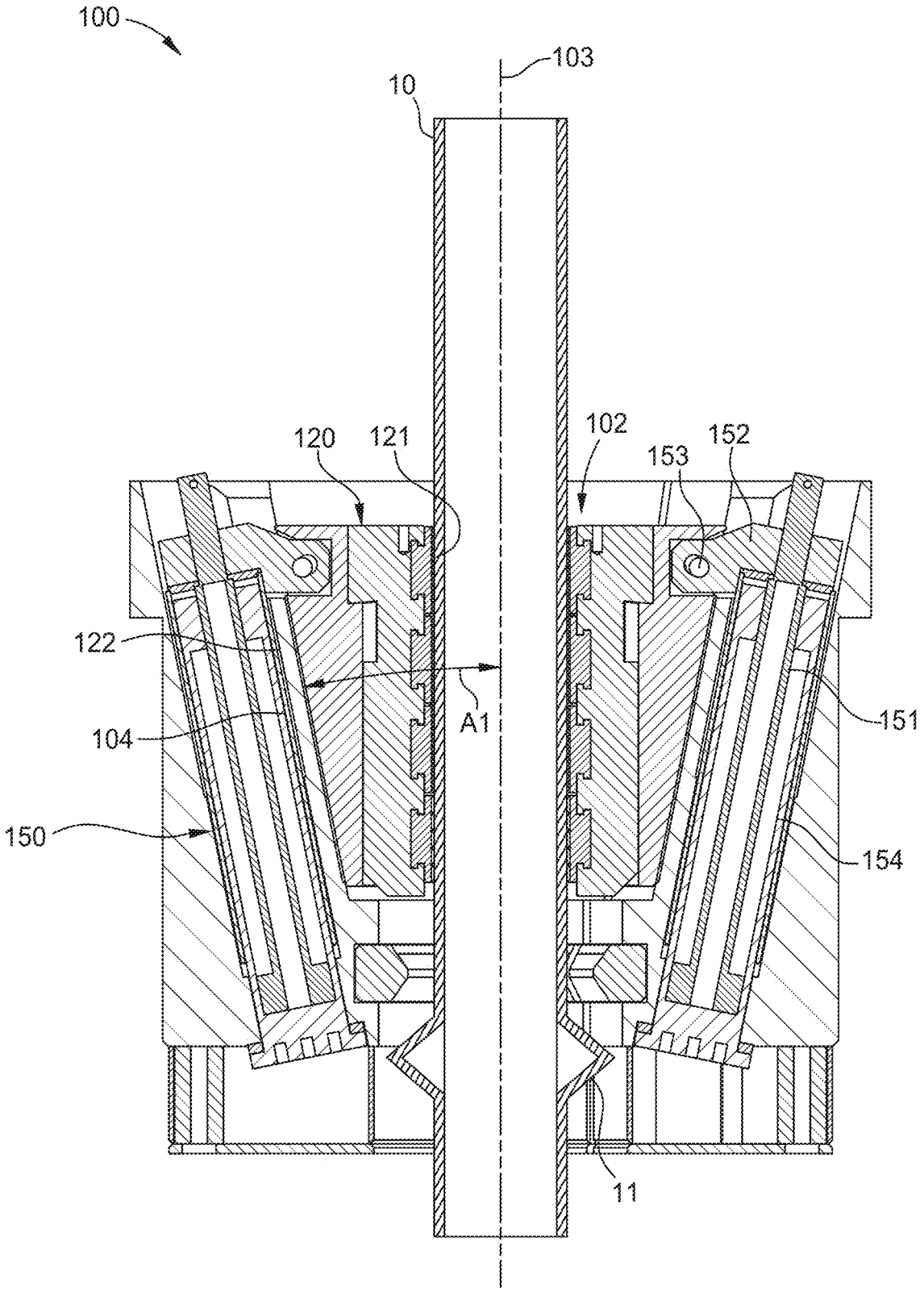
FIG. 2B illustrates a cross-sectional view of the hydraulic spider of FIG. 1 with the slips in an engaged position, according to one or more embodiments.

FIGS. 2A-2B illustrate cross-sectional views of the hydraulic spider 100 with the slips 120 operating between a set-back position, as shown in FIG. 2A, and an engaged position, as shown in FIG. 2B.

According to one mode of operation, a tubular 10 is placed in the bore 102 of the hydraulic spider 100 and the slips 120 extend from a retracted position (e.g., the set-back position), as shown in FIG. 2A, inward towards the central axis 103 of the hydraulic spider 100 to engage with the tubular 10 (e.g., the engaged position), as shown in FIG. 2B. With the tubular 10 engaged and held in place by the slips 120, the tubular 10 may be made-up or broken-out from another tubular. As such, the hydraulic spider 100 is designed to engage and hold the tubular 10 to prevent axial and rotational movement of the tubular 10 while making-up or breaking-out a threaded connection with the tubular 10.

The bore 102 is at least partially defined by the slips 120 and the spider body 101. Although four slips 120 are shown in FIGS. 1-2B, the hydraulic spider 100 may include two, three, four, five, six, seven, eight, or more slips 120. The number of slips 120 may depend on the surface area needed to retain the tubular 10 while the tubular is experiencing a torque or axial load, and while also preventing the tubular 10 from being crushed.

The slips 120 include an inner surface 121 and an outer surface 122. The inner surface 121 is configured to engage with the tubular 10. The outer surfaces 122 of the slips are slidably engaged with actuation surfaces 104 of the spider body 101 such that the slips 120 can be moved along the actuation surfaces 104 by actuators 150. Each slip 120 may be coupled to a cylinder rod 151 of an actuator 150 by a connection member 152 comprising a pin 153. The cylinder rod 151 may be extended from and retracted into a cylinder 154 of the actuator 150 to raise and lower the slip 120 along the actuation surfaces 104.

The actuation surfaces 104 are tapered at an angle with respect to the central axis 103. For instance, the actuation surfaces 104 may be tapered at an angle A1 of about 11 degrees or more, or about 11 degrees to about 20 degrees from the central axis 103. In one or more embodiments, the actuation surfaces 104 may be about 200 mm to about 500 mm long. In one or more embodiments, the actuators 150 have a stroke of about 200 mm to about 500 mm. The outer surfaces 122 of the slips 120 are similarly angled (e.g., angled complementary to the actuation surfaces 104) such that as the slips 120 slide along the actuation surfaces 104, the inner surfaces 121 of the slips 120 stay about perpendicular to the ground (e.g., the inner surfaces 121 are aligned with, or generally parallel to, the central axis 103 of the hydraulic spider 100). In one or more embodiments, the inner surfaces 121 may stay aligned with the outer surface of the tubular 10 such that, in the engaged position, as shown in FIG. 2B, the inner surfaces 121 engage with the outer surface of the tubular. For example, as the slips 120 are moved up the actuation surfaces 104, the inner surfaces 121 are moved radially outward away from the central axis 103 (moving the slips 120 into the set-back position shown in FIG. 2A) while staying about perpendicular to the ground. And as the slips 120 are moved down the actuation surfaces 104, the inner surfaces 121 are moved radially inward towards the central axis 103 (moving the slips 120 into the engaged position shown in FIG. 2B) while staying about perpendicular to the ground.

The angle A1 of the actuation surfaces 104 and the distance traveled along the actuation surfaces 104 (e.g., the stroke of the actuators 150 or the length of the actuator surfaces 104) determines the position of the inner surfaces 121 in the set-back and engaged positions. The angle and length of the actuation surfaces 104 also determines the radial stroke of each slip 120 (e.g., the radial distance between the inner surface 121 in the engaged position and position of the inner surface 121 in the set-back position). Maximizing the radial stroke of each slip 120 allows for a larger range of diameters of tubulars 10 that may be engaged by the same slips 120 and the same hydraulic spider 100. Further, maximizing the radial stroke of each slip 120 allows for the hydraulic spider 100 to be used with tubulars 10 including external components or features extending past the diameter (e.g., that are located on the diameter) of the tubular 10, such as tubular centralizers 11.

The slips 120 engage with, and disengage from, the outer diameter of the tubular 10. However, tubulars 10 may include external components or features that extend past the outer diameter (e.g., that are located on the outer diameter), such as tubular centralizers 11. Such tubulars 10 with external components or features still need to be lowered or raised through the bore 102 and the slips 120 of the hydraulic spider 100. Therefore, maximizing the radial stroke of the slips 120 allows for tubulars 10 with external components and/or features to be raised and lowered through the bore 102 and the slips 120 of the hydraulic spider 100 without disassembly or interference. For example, the tubular 10 with the tubular centralizers 11 extending to a larger diameter than the diameter of the tubular 10 may be passed through the hydraulic spider 100 without disassembly and/or swapping out the slips 120 due to the maximized radial stroke of each slip 120.

Further, maximizing the radial stroke of the slips 120 allows for a more varied range of diameters of tubulars 10 that may be engaged by the same hydraulic spider 100 and slips 120.

While FIGS. 2A-2B illustrate the slips 120 in the set-back and engaged positions, it is understood that the slips 120 may be in any intermediate position between the set-back and engaged position as necessary for installation of varying diameters of tubulars and components and/or features such as the tubular centralizers 11.

Figure 3:
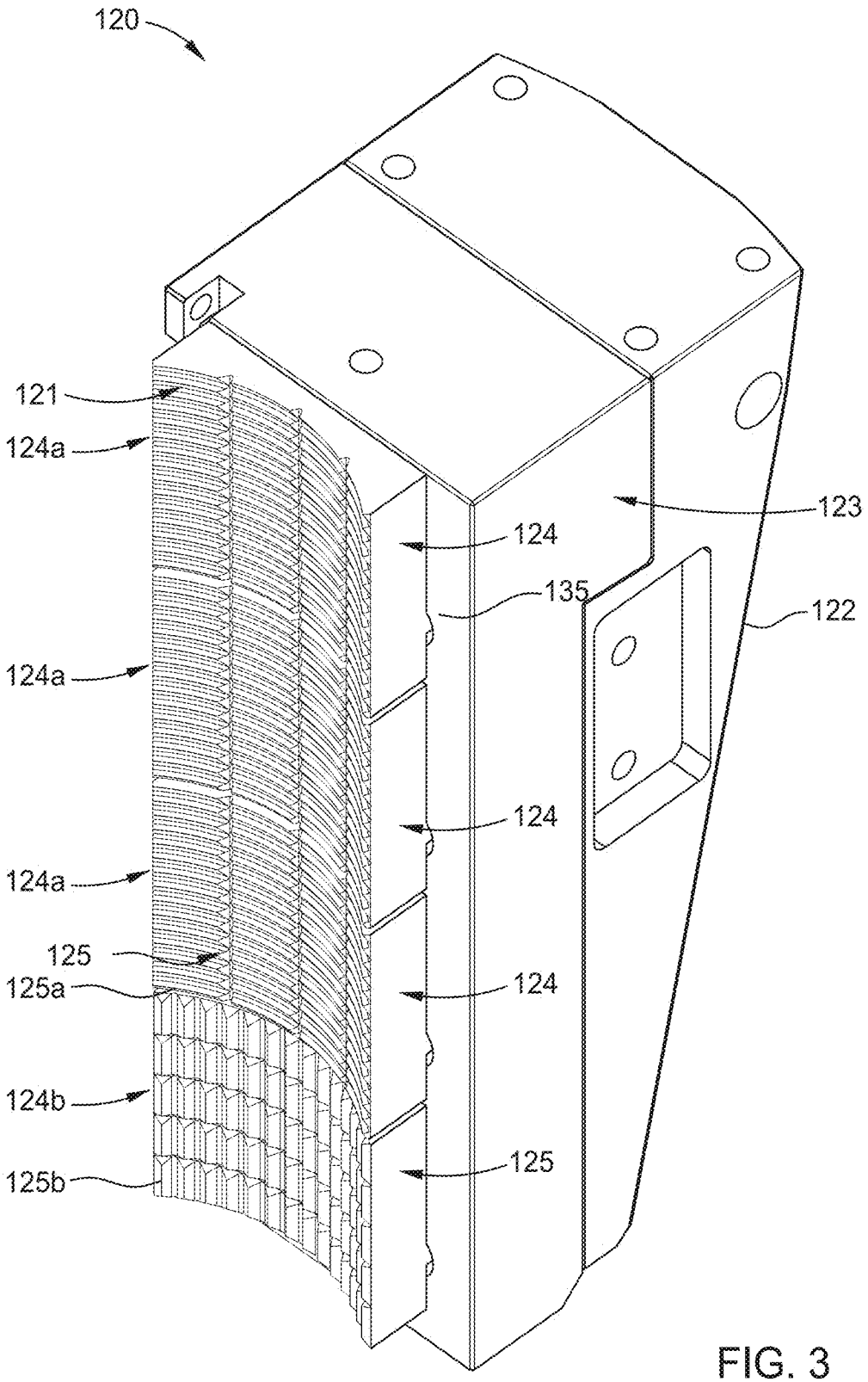
FIG. 3 illustrates an isometric view of a slip of the hydraulic spider of FIG. 1, according to one or more embodiments.

FIG. 3 illustrates an isometric view of one of the slips 120. The slip 120 includes a body 123 and inserts 124 removably coupled to an inner surface 135 of the body 123. The body 123 may comprise one or more body portions coupled together or may comprise a single monolithic body.

The body 123 may be wedge-shaped and includes the outer surface 122 of the slip 120. The inserts 124 are coupled to the inner surface 135 of the body 123 and form the inner surface 121 of the slip 120.

In one or more embodiments, the inserts 124 may be at least partially disposed in and removably coupled to the inner surface 135 of the body 123. In one or more embodiments, the inserts 124 may be coupled to the inner surface 135 of the body 123 by fasteners. The inserts 124 are coupled to the inner surface 135 of the body 123 in a stacked arrangement (e.g., positioned above and/or below adjacent inserts 124). Each insert 124 extends across the width of the body 123. In one or more embodiments, the slip 120 may include an array of inserts 124 with any number of rows and columns.

There may be two or more inserts 124 per slip 120. In one or more embodiments, there may be four inserts 124 per slip 120, as illustrated. In one or more embodiments, there may be two, three, four, five, six, seven, eight, or more inserts 124 per slip 120.

The wedge-shape of the body 123 allows for the outer surface 122 to include a complementary angle to the actuation surface 104 of the hydraulic spider 100 so that the slips 120 may move along the actuation surface 104 to move the inner surface 121 of the slips 120 radially inward and outward while keeping the inner surface 121 parallel to the central axis of 103 of the hydraulic spider 100, as described above with respect to FIGS. 2A and 2B.

The inserts 124 include a plurality of teeth 125. There are inserts 124*a* with horizontal teeth 125*a* and there are inserts 124*b* with vertical teeth 125*b*. In one or more embodiments, there are multiple inserts 124*a* with horizontal teeth 125*a* and a single insert 124*b* with vertical teeth 125*b*. For example, as illustrated, there are three inserts 124*a* with horizontal teeth 125*a* disposed above one insert 124*b* with vertical teeth 125*b*. However, it is contemplated that there may be any number of inserts 124*a* with horizontal teeth 125*a* and any number of inserts 124*b* with vertical teeth 125*b* organized in any array in a slip 120.

Figure 4:
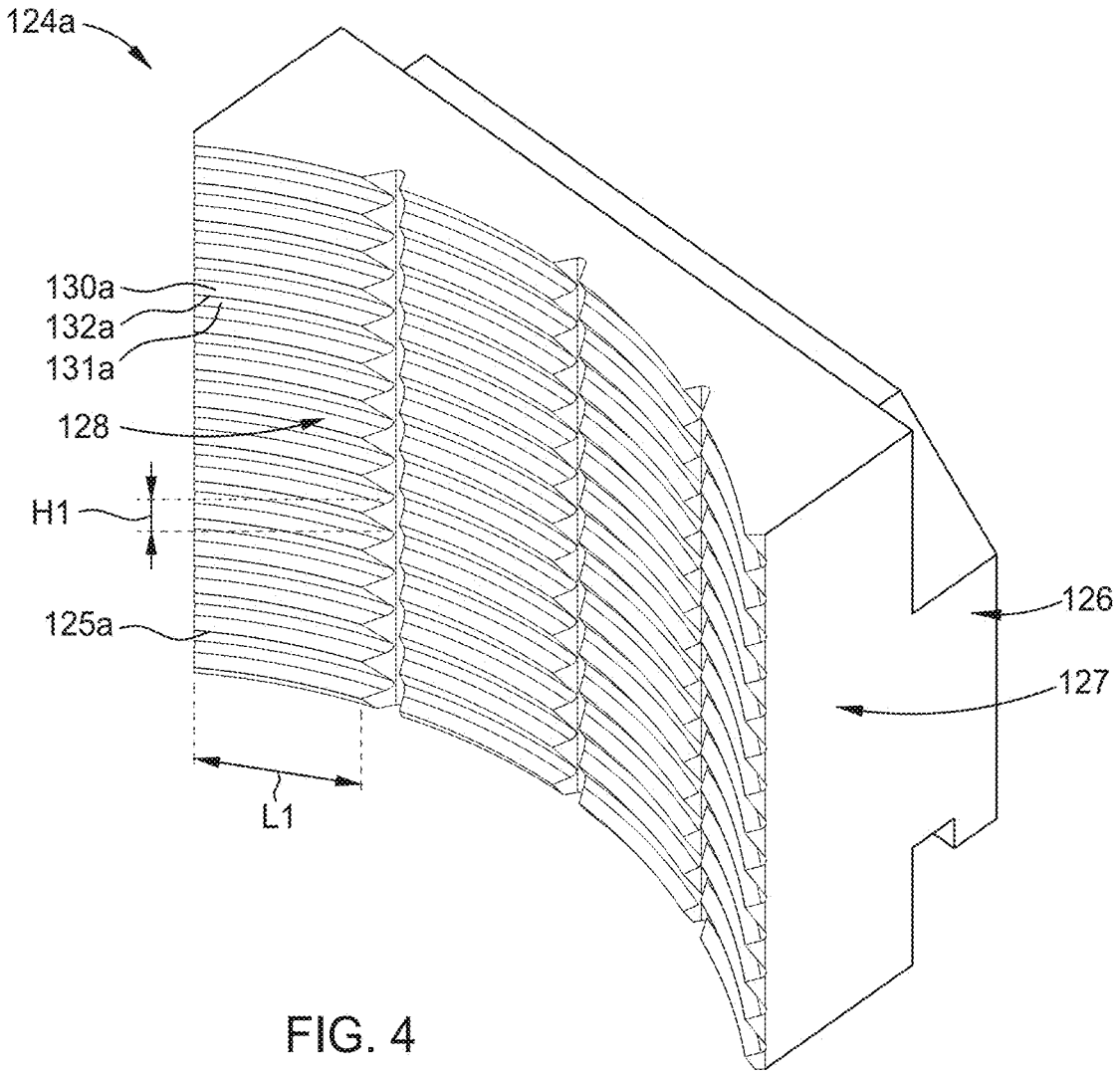
FIG. 4 illustrates an isometric view of an insert of the slip of FIG. 3 with horizontal teeth, according to one or more embodiments.
Figure 5:
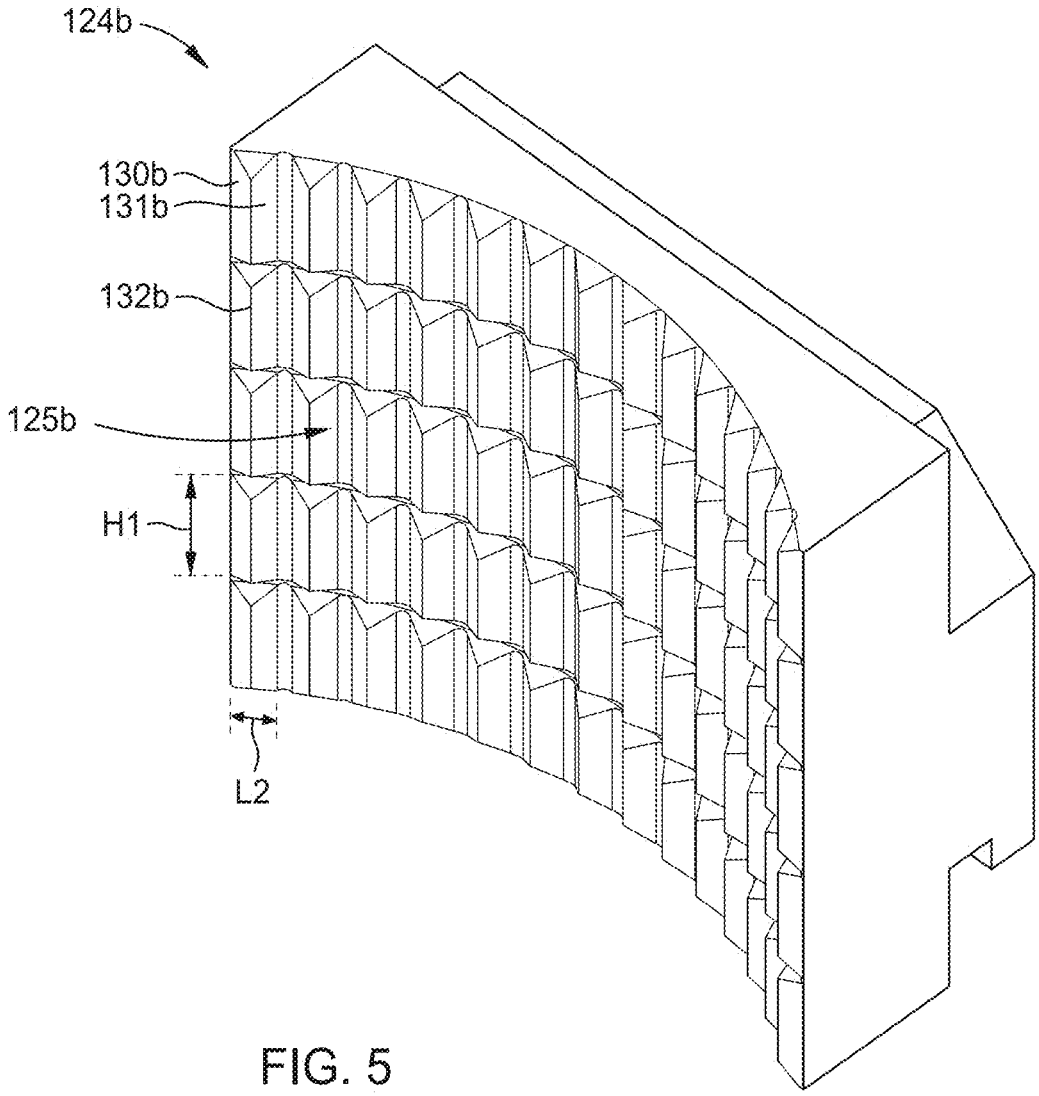
FIG. 5 illustrates an isometric view of an insert of the slip of FIG. 3 with vertical teeth, according to one or more embodiments.

FIG. 4 illustrates an insert 124*a* with horizontal teeth 125*a* and FIG. 5 illustrates an insert 124*b* with vertical teeth 125*b*.

Each insert 124 includes an installation body 126 and an engagement body 127. The installation body 126 is disposed on the side of the insert 124 that is coupled to the body 123 of the slip 120. The installation body 126 may be a protrusion extending from the engagement body 127 that may be at least partially disposed into one or more recesses in the body 123 of the slip 120. In one or more embodiments, the inserts 124 are coupled to the body 123 by sliding the installation body 126 into a recess in the body 123 of the slip 120.

The engagement body 127 protrudes from the body 123 of the slip 120 and includes an engagement surface 128. The engagement surface 128 is concave. The engagement surface 128 of the inserts 124 form the inner surface 121 of the slip 120. The engagement surface 128 engages with the outer diameter of the tubular 10. The concavity of the engagement surface 128 at least partially defines the bore 102 of the hydraulic spider 100. The combination of the engagement surfaces 128 of each insert 124 in each slip 120 defines a portion of a partial circle shaped to engage the tubular 10 when in the engaged position.

The engagement surface 128 includes the teeth 125. In one or more embodiments, the teeth 125 are integrally formed in the engagement body 127 of the insert 124. In one or more embodiments, the teeth 125 are cut into the engagement surface 128. In one or more embodiments, the teeth 125 may be generally shaped as triangular prisms.

The teeth 125 may be horizontal teeth 125*a* or vertical teeth 125*b*. FIG. 4 illustrates an insert 124*a* with horizontal teeth 125*a*. FIG. 5 illustrates an insert 124*b* with vertical teeth 125*b*. While the teeth 125 are described as horizontal and vertical, it is contemplated that the teeth 125 may be in any orientation so long as one set of teeth of one insert are oriented in a first direction and the second set of teeth of another insert are oriented in a second, different direction. The first and second directions may be angled with respect to each other, such as perpendicular to each other.

As shown in FIG. 4, the horizontal teeth 125*a* may be longer than they are tall. That is, the horizontal teeth 125*a* may have a length L1 in the direction perpendicular to the central axis 103 that is larger than the height H1 in the direction parallel to the central axis 103. In one or more embodiments, L1 may be about 6 mm to about 24 mm. In one or more embodiments, H1 may be about 5 mm to about 8 mm.

In one or more embodiments, the horizontal teeth 125*a* have a triangular cross section when the cross-section is taken at a plane parallel to the central axis 103 and a trapezoidal or rectangular cross section when the cross section is taken at a plane normal to the central axis 103. In one or more embodiments, the horizontal teeth 125*a* are saw-toothed (e.g., the horizontal teeth 125*a* may have a cross section that is a right-triangle when the cross-section is taken at a plane parallel to the central axis 103). In one or more embodiments, the saw-tooth is angled upwards. In one or more embodiments, the horizontal teeth 125*a* have an upper surface 130*a* that is flat (e.g., normal to the central axis 103 of the hydraulic spider 100) or substantially flat. In one or more embodiments, the horizontal teeth 125*b* may have a lower surface 131*a* that is angled up towards the upper surface 131*a*. The upper surface 130*a* and the lower surface 131*a* meet at an edge 132*a*. The edge 132*a* is what engages with the tubular 10 when the hydraulic slip 120 is in the engaged position.

While horizontal teeth 125*a* are described as saw-toothed in an upward direction, it is contemplated that the horizontal teeth 125*a* may not be saw-toothed.

As shown in FIG. 5, the vertical teeth 125*b* may be taller than they are long. That is, the vertical teeth 125*b* may have a length L2 in the direction perpendicular to the central axis 103 that is less than the height H2 in the direction parallel to the central axis 103. In one or more embodiments, L2 may be about 6 mm to about 9 mm. In one or more embodiments, H2 may be about 5 mm to about 15 mm.

In one or more embodiments, the vertical teeth 125*b* have a triangular cross section when the cross-section is taken at a plane normal to the central axis 103. In one or more embodiments, the vertical teeth 125*b* have a cross section that is an isosceles or equilateral triangle when taken at said plane. In one or more embodiments, the vertical teeth 125*b* have a trapezoidal or rectangular cross section in the plane parallel to the central axis 103. In one or more embodiments, the vertical teeth 125*b* have a first end surface 130*b* and a second end surface 131*b* that come together at an edge 132*b* towards the central axis 103. The edge 132*b* engages with the tubular 10 when the hydraulic slip 120 is in the engaged position.

In one or more embodiments, each slip 120 includes one, two, three or more inserts 124*a* that have horizontal teeth 125*a* and are located above at least one insert 124*b* that has vertical teeth 125*b*. In one or more embodiments, each slip 120 includes the same number of inserts 124 with the same teeth orientation and configuration. As an example, all of the inserts 124 at the same level in the hydraulic spider 100 (e.g., at the same axial height along the central axis 103 of the hydraulic spider 100) may be mirror images of one another.

Figure 6:
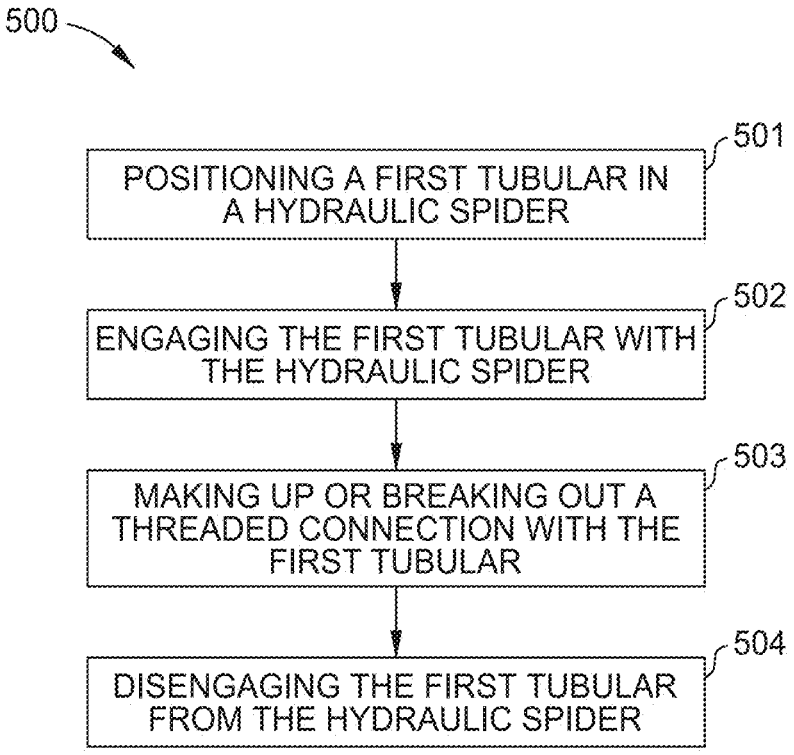
FIG. 6 illustrates a method for engaging tubulars with a hydraulic spider, according to one or more embodiments.

FIG. 6 illustrates a method 500 for engaging tubulars (such as tubular 10 of FIGS. 2A-2B) with a hydraulic spider (such as hydraulic spider 100 of FIGS. 1-2B), according to one or more embodiments.

At step 501, a first tubular (of a tubular string) is positioned in a bore (such as bore 102 of FIGS. 1-2B) of the hydraulic spider, which is in a set-back position (such as the set-back position shown in FIG. 2A) or an intermediate position between the set-back position and an engaged position (as shown in FIG. 2B). The first tubular may be positioned in the bore of the hydraulic spider by an elevator. The first tubular has a first diameter. In one or more embodiments, the first tubular may include external features or components extending outside of the first diameter, such as centralizer 11 of FIGS. 2A-2B. In one or more embodiments, the first tubular is lowered into the bore of the hydraulic spider or raised into the bore of the hydraulic spider such that the external features or components pass through the bore of the hydraulic spider and the first tubular is moved into a position for engagement by the hydraulic spider.

At step 502, the first tubular is engaged by one or more slips (such as slips 120 of FIGS. 1-3) of the hydraulic spider. The first tubular is engaged by moving the one or more slips to the engaged position. Moving the one or more slips to the engaged position may include moving an angled outer surface of the slips (such as outer surface 122 of FIGS. 2A-3) along angled actuation surfaces (such as actuation surface 104 of FIGS. 2A-2B) of the hydraulic spider. In one or more embodiments, the actuation surfaces may be angled about 11 degrees to about 20 degrees from a central axis (such as central axis 103 of FIGS. 1-2B) of the hydraulic spider. In one or more embodiments, moving the slips along the actuation surfaces includes moving the slips with one or more actuators (such as actuators 150 of FIGS. 2A-2B) coupled to the slips and the hydraulic spider.

In the engaged position, inserts (such as inserts 124 of FIGS. 3-4) disposed in the slips including engage with the outer diameter of the tubular. The inserts include inserts with horizontal teeth (such as inserts 124*a* with horizontal teeth 125*a* of FIGS. 3-4) and inserts with vertical teeth (such as inserts 124*b* with vertical teeth 125*b* of FIGS. 3 and 5).

At step 503, while the first tubular is engaged by the hydraulic spider, another tubular or tubular string is made up to or broken out from a threaded connection with the first tubular.

At step 504, the first tubular is disengaged by the hydraulic spider after being re-engaged by the elevator. In one or more embodiments, the slips are moved from the engaged position to the set-back position (or an intermediate position). Moving the one or more slips from the engaged to the set-back position or intermediate position may include moving the angled outer surface of the slips along the angled actuation surfaces of the hydraulic spider. In one or more embodiments, moving the slips along the actuation surfaces includes moving the slips with the one or more actuators coupled to the slips and the hydraulic spider. The first tubular may then be removed from the hydraulic spider by the elevator.

Any one or more components of the hydraulic spider 100 may be integrally formed together, directly coupled together, and/or indirectly coupled together and are not limited to the specific arrangement of components illustrated in FIGS. 1-5. Any one or more of the components, embodiments, or steps of the hydraulic spider 100 and method 500, may be combined in whole or part with any other components, embodiments, or steps of the hydraulic spider 100 and method 500.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A slip for use in a hydraulic spider, comprising:

a slip body having an upper portion and a lower portion;

a first insert coupled to the upper portion of the slip body, the first insert including a first engagement surface, wherein the first engagement surface includes one or more first teeth oriented in a first direction; and a second insert coupled to the lower portion of the slip body and disposed below the first insert, the second insert including a second engagement surface, wherein the second engagement surface includes one or more second teeth oriented in a second, different direction, wherein only the upper portion has the first insert and the lower portion has the second insert, and wherein the one or more first teeth are horizontal teeth and the one or more second teeth are vertical teeth.

2. The slip of claim 1, wherein the first direction is perpendicular to the second direction.

3. The slip of claim 1, wherein the one or more first teeth have a triangular cross-section and the one or more second teeth have a triangular cross-section.

4. The slip of claim 1, wherein the one or more first teeth are saw-toothed and angled upwards.

5. The slip of claim 1, wherein the one or more first teeth are longer than they are tall, and wherein the one or more second teeth are taller than they are long.

6. The slip of claim 1, further comprising a third insert coupled to the upper portion of the slip body, wherein the third insert is disposed between the first insert and the second insert, wherein the third insert includes a third engagement surface including one or more third teeth oriented in the first direction, and wherein there is only a single second insert coupled to the lower portion of the slip body.

7. A slip for use in a hydraulic spider, comprising:

a slip body having an upper portion and a lower portion;

a first insert at least partially disposed in the upper portion of the slip body, including one or more first teeth oriented in a first direction; and a second insert at least partially disposed in the lower portion of the slip body and disposed below the first insert, wherein the second insert includes one or more second teeth oriented in a second direction, wherein the second direction is perpendicular to the first direction, wherein only the upper portion has the first insert and the lower portion has the second insert, and wherein the one or more first teeth are horizontal teeth and the one or more second teeth are vertical teeth.

8. The slip of claim 7, further comprising a third insert coupled to the upper portion of the slip body, wherein the third insert is at least partially disposed in the slip body between the first insert and the second insert, and wherein the third insert includes one or more third teeth oriented in the first direction.

9. The slip of claim 8, wherein the one or more third teeth are horizontal teeth.

10. The slip of claim 7, wherein the one or more first teeth are longer than they are tall, and wherein the one or more second teeth are taller than they are long.

11. The slip of claim 7, wherein the one or more first teeth have a triangular cross-section and the one or more second teeth have a triangular cross section.

12. The slip of claim 7, wherein the one or more first teeth are saw-toothed and angled upwards.

13. A hydraulic spider, comprising:

a hydraulic spider body including a bore and one or more actuation surfaces, wherein the one or more actuation surfaces includes a taper angle of at least 11 degrees; and a plurality of slips engaged with the one or more actuation surfaces such that movement along the one or more actuation surfaces causes the slips to move radially inward towards a center of the bore or radially outward away from the center of the bore, the slips including one or more inserts defining an inner surface of each slip, the one or more inserts including:

a first insert coupled to an upper portion of the slip, wherein the first insert includes one or more first teeth oriented in a first direction; and a second insert coupled to an lower portion of the slip and disposed below the first insert, wherein the second insert includes one or more second teeth oriented in a second direction, and wherein the second direction is different from the first direction, wherein only the upper portion has the first insert and the lower portion has the second insert, and wherein the one or more first teeth are horizontal teeth and the one or more second teeth are vertical teeth.

14. The hydraulic spider of claim 13, wherein the first direction is perpendicular to the second direction.

15. The hydraulic spider of claim 13, wherein the one or more actuation surfaces include a taper angle of 11 degrees to 20 degrees from a central axis of the hydraulic spider body.

16. The hydraulic spider of claim 13, wherein the one or more first teeth are longer than they are tall, and wherein the one or more second teeth are taller than they are long.

17. The hydraulic spider of claim 13, wherein the slips further comprising a third insert coupled to the upper portion of the slip body, wherein the third insert is disposed in between the first insert and the second insert, wherein the third insert includes one or more third teeth oriented in the first direction, and wherein there is only a single second insert coupled to the lower portion of the slip body.

* * * * *